US010946261B2

(12) United States Patent
Arredondo

(10) Patent No.: US 10,946,261 B2
(45) Date of Patent: Mar. 16, 2021

(54) PUNCHING SURFACE

(71) Applicant: Natalia Y Arredondo, Carrollton, TX (US)

(72) Inventor: Natalia Y Arredondo, Carrollton, TX (US)

( * ) Notice: Subject to any disclaimer, the term of this patent is extended or adjusted under 35 U.S.C. 154(b) by 55 days.

(21) Appl. No.: 16/409,232

(22) Filed: May 10, 2019

(65) Prior Publication Data

US 2020/0353340 A1 Nov. 12, 2020

(51) Int. Cl.
*A63B 69/34* (2006.01)
*A63B 69/00* (2006.01)

(52) U.S. Cl.
CPC ..... *A63B 69/34* (2013.01); *A63B 69/004* (2013.01)

(58) Field of Classification Search
CPC ..... A61H 3/008; A61H 1/0218; A63B 69/20–345; A63B 21/16–1663; A63B 7/10; A63B 7/20; A63B 69/0073–0088; A63B 2225/05
See application file for complete search history.

(56) References Cited

U.S. PATENT DOCUMENTS 4,050,693 A * 9/1977 Lichterman ..... A63B 21/1627 482/87
4,667,954 A * 5/1987 McCorkle ..... A63B 69/26 473/444
5,240,460 A * 8/1993 Tighe ..... A63B 21/1627 248/200.1
5,607,377 A * 3/1997 Wilkinson ..... A63B 5/11 482/27
6,398,673 B1 * 6/2002 Maruca ..... A63B 21/1627 473/415
2008/0182729 A1 * 7/2008 Ziska ..... A63B 69/34 482/89
2015/0057132 A1 * 2/2015 Pedone ..... A63B 69/34 482/83
2018/0296897 A1 * 10/2018 Horn ..... A63B 69/002

* cited by examiner

*Primary Examiner* — Jennifer Robertson
*Assistant Examiner* — Catrina A Letterman

(57) ABSTRACT

A padded punching surface incorporating elastic roping connected to a frame which allows the punching surface to be struck with a force of impact by a user so as to minimize swinging of the punching surface. The apparatus is an improvement on existing punching bags which enables easier convenient and more realistic combat training for athletes and users. The amount of swing for the punching surface can be adjusted by tightening or loosening the elastic roping. The punching surface can include an attached head shaped surface for more realism.

8 Claims, 11 Drawing Sheets

PUNCHING SURFACE

FIELD OF THE INVENTION

The present invention relates to novel training devices intending to receive forces of impact by individuals practicing martial arts. The invention disclosed herein configures a custom punching surface suspended to a frame able to rebound back to the user after the force of impact is delivered, rather than swing away like conventional punching bags.

BACKGROUND

Training for athletes and martial artists can be enhanced by using a punching bag. A typical punching bag has a cylindrical shape suspended from the top of the bag by chains or rope, allowing it to swing. A force of impact delivered by a user to a typical punching bag will cause the bag to swing. The swinging motion of the bag is unrealistic compared to actual combat and makes training more difficult than it would be if such swinging did not occur. As a result, considerable practice must be devoted to learning the coordination of the swinging punching bag. While it is possible to modify punching bags with weighted bases, athletes prefer that the punching bag would not swing and have a more combat realistic reaction. If the amount of swinging could be reduced, or cut out completely, the training would be easier and more efficient.

The present invention allows for a rectangular shaped punching surface to be suspended by elastic ropes to a frame to minimize swinging.

SUMMARY OF THE INVENTION

The present invention comprises a rectangular padded punching surface supported by elastic roping connecting to a rack or mount by carabiners. This gives the punching surface a sense of realism by restricting the amount of swing that occurs when the surface is hit by the user. The elastic roping can be adjusted to the user's preference, if the user tightens the ropes the punching surface will swing less, if the user loosens the ropes the punching surface will swing more. This allows the surface to be hit by the user and quickly reset to its original position.

In one of many alternative embodiments, the punching surface can be suspended to a portable and adjustable frame, said frame being able to be wedged into a conventional doorway. Or in another alternative embodiment the punching surface can be suspended to a fitness power rack. Or in another alternative embodiment the punching surface can be suspended from a wall mount. In this and any alternative embodiment of this invention described herein, the punching surface can include a humanoid shaped head for more realism.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a", "an", and "the" are intended to include the plural forms as well as the singular forms, unless the context clearly indicates otherwise. It will be further understood that the terms "comprises" and "comprising", when used in this specification, specify the presence of stated features, steps, operations, elements, and components, but do not preclude the presence or addition of one or more other features, steps, operations, elements, components, or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present disclosure is to be considered as an exemplification of the invention, and is not intended to limit the invention to the specific embodiments illustrated by the figures or description below.

Figure 1:
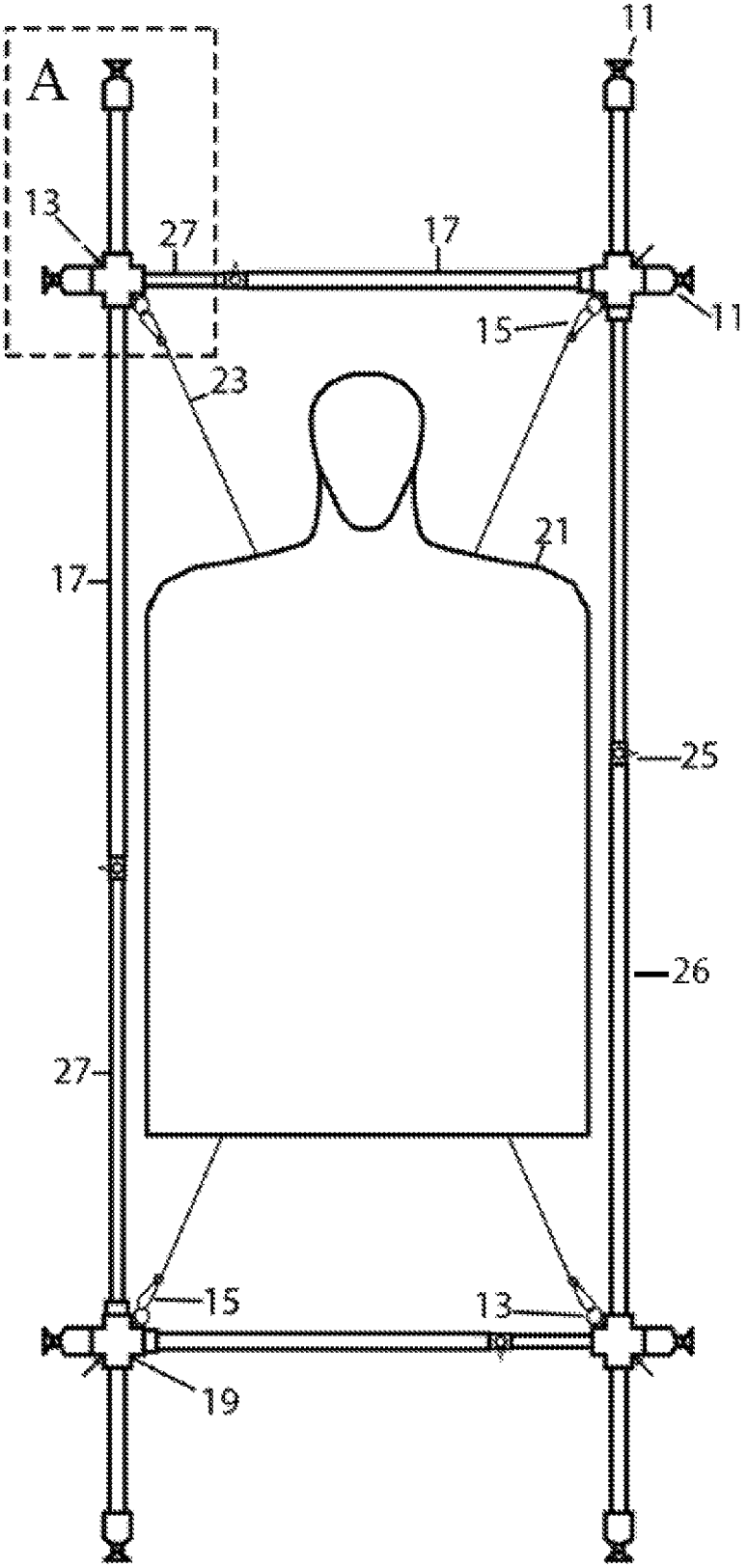
FIG. 1 shows the invention as a door-mounted punching surface embodiment.

The present invention will now be described by referencing the appended figures representing preferred embodiments. FIG. 1 depicts a front view of the door-mounted punching surface embodiment. The padded punching surface comprises front padding 21 on a punching surface 35, optional edge padding 31, and optional back padding 29, all which form a rectangular and humanoid head shape surface in the current embodiment capable of withstanding large forces of impact. Said padded punching surface 35 is suspended from a door-mounted frame 26 by two elastic ropes 23 that are ran across the back of the punching surface 35. The elastic ropes 23 are strung from opposing corners to the eye screws 13 by carabiners 15 on the door-mounted frame 26. The eye screws 13 are mounted to the PVC cross 19 that connects PVC pipe framing elements 27, metal pipe framing elements 17, and suction cup attachments 11 comprising the door-mounted frame 26 wherein a punching surface 35 is suspended.

Figure 11:
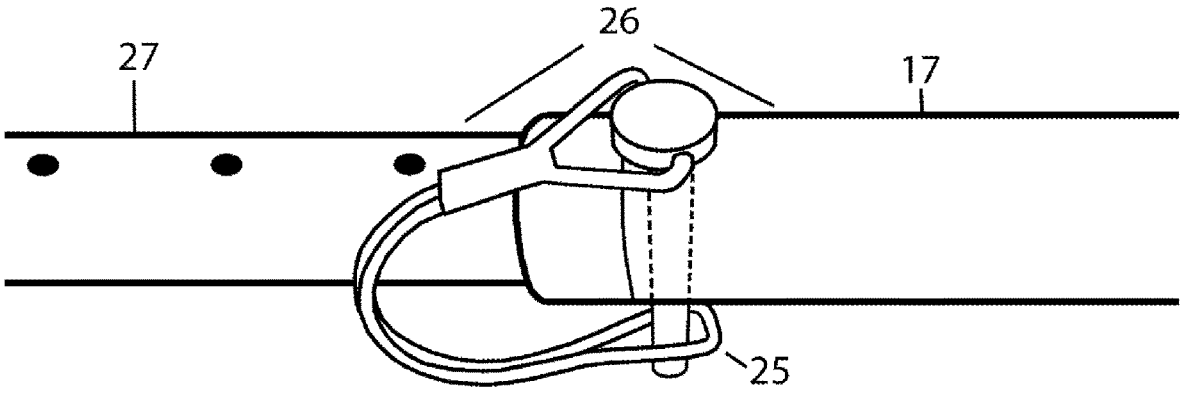
FIG. 11 is an orthogonal view of one embodiment of a lock pin connection 25 as shown in Frame B of FIG. 3.

In this first embodiment, the door-mounted frame 26 includes PVC pipe framing elements 27 and metal pipe framing elements 17 which are joined by a conventional lock pin 25 (comprising matching holes in the two pipes wherein a pin is placed through the holes to fix the pipes in position together, as shown in FIG. 11). In this embodiment, the PVC pipe framing elements 27 have a smaller diameter than the metal pipe framing elements, such that the PVC pipe framing elements 27 fits snugly inside the metal pipe framing elements 17 and can slide in and out unless restrained by the lock pin 25.

While this embodiment uses larger metal pipe framing elements and smaller PVC piping sections, the invention could use two different sizes of metal piping, or two different sizes of PVC piping. The invention is in no way limited to those materials; many materials would provide sufficient strength and rigidity for the task of mounting a punching surface using elastic ropes 23 to suspend the punching surface 35 in the space defined by the plane of the interior of the frame 26.

The lock pin 25 allows the user to adjust the frame 26 to compensate for doorway lengths or to collapse the door-mounted frame 26 for convenient transportation. The PVC pipe framing elements 27 and metal pipe framing elements 17 are joined by PVC cross 19 to form a rectangular mounted frame 26 with enough empty space inside the mounted frame 26 to encompass the punching surface 35 that is connected with elastic ropes 23 to opposing corners inside of the door-mounted frame 26.

The corners of the mounted frame 26 comprise the PVC cross 19 into which metal pipe framing elements 17 and PVC pipe framing elements 27 are attached (see FIG. 2) to create the rectangular mounted frame 26 with sufficient space for the punching surface 35 to be suspended inside the space defined by the frame 26, and hold the suction cup attachments 11 connected to the exterior-facing portion of the frame 26.

The suction cup attachment 11 comprises a suction cup threaded through a PVC pipe cap connected to the PVC pipe framing elements 27 to the PVC cross 19. The door-mounted frame 26 can be placed in a door way and adjusted to fit the door way by the lock pin 25 position and remains in place by the suction cup attachments 11 that seal the frame to the doorway.

Figure 2:
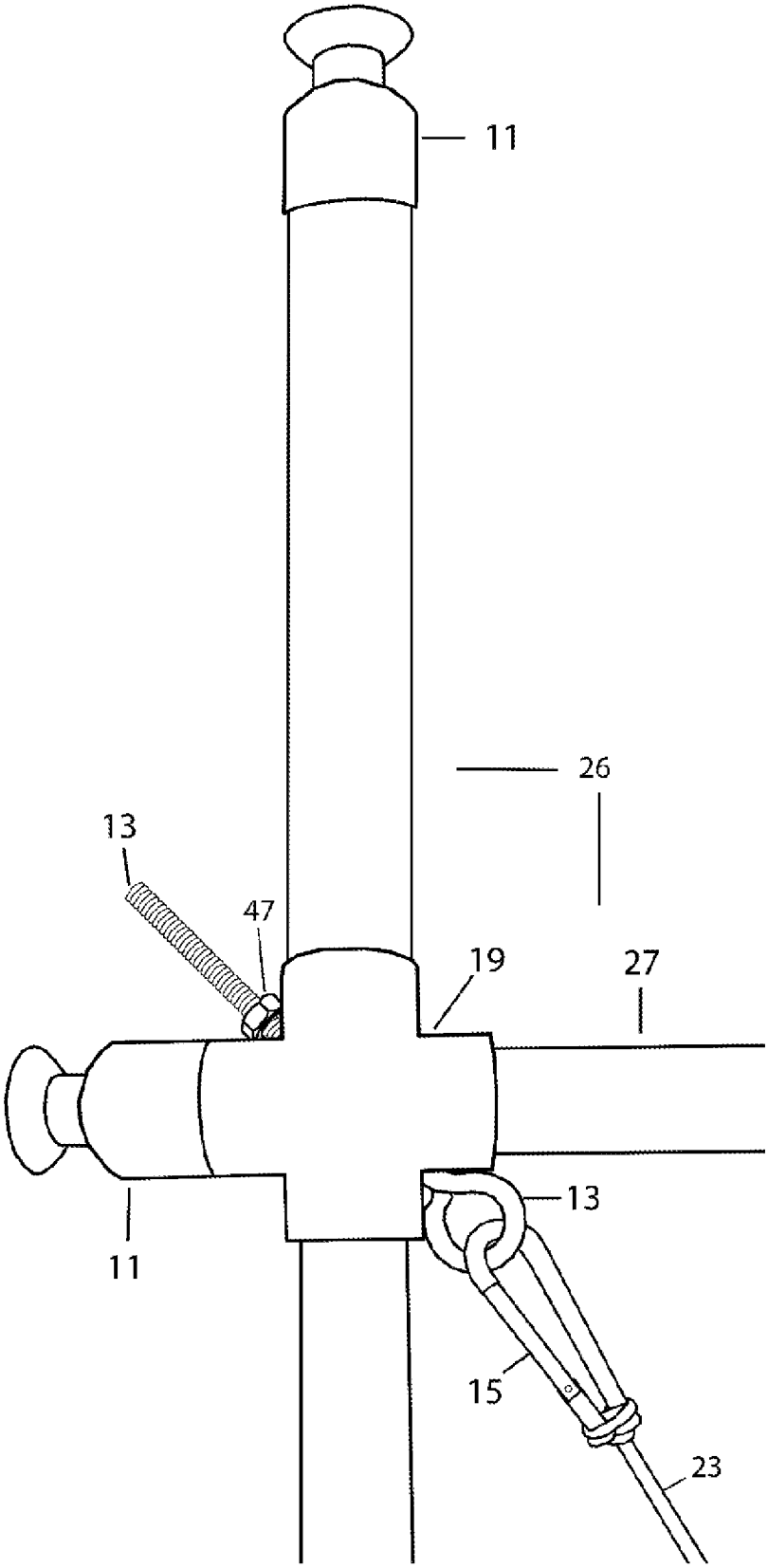
FIG. 2 is a front view of Section A of the door-mounted frame as indicated in FIG. 1.

FIG. 2 is a front view of the section of the door-mounted frame that is framed by the rectangular area described by the dotted-line rectangle marked as section A in FIG. 1. The PVC pipe framing elements 27 attaches the right and the bottom ports of the PVC cross 19 to make the mounted frame 26. The left and top ports of the PVC Cross connect to a suction cup attachment 11 with additional PVC pipe framing elements 27 extending the top suction cup attachment 11 to compensate for doorframe height. The elastic ropes 23 are tied to a carabiner 15 that is attached to an eye screw 13 that is threaded through the PVC cross 19 and secured with an eye screw nut 47.

Figure 3:
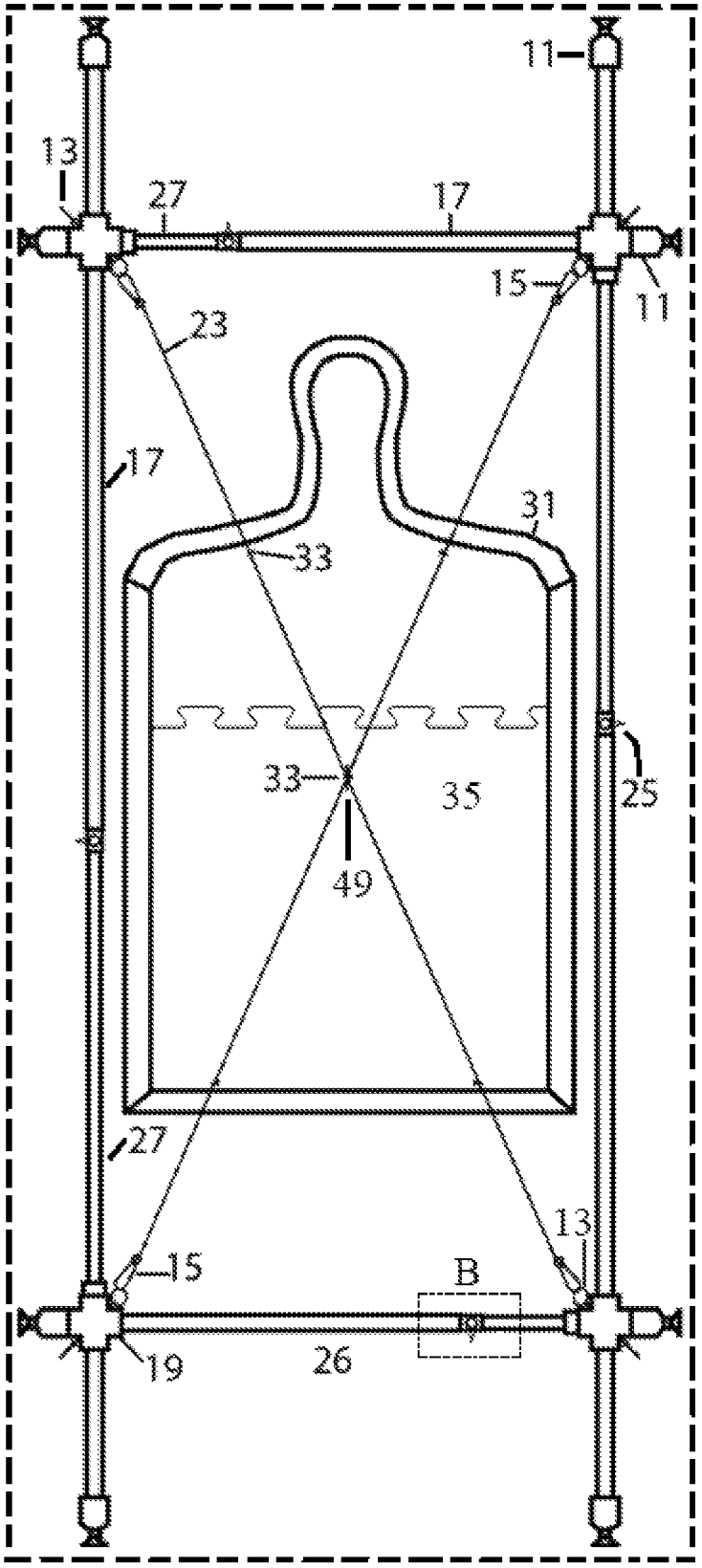
FIG. 3 is a front view of the invention, embodied as a door-mounted punching surface with front padding removed. (The doorway is not part of the invention.)

FIG. 3 depicts the front of the door-mounted punching surface embodiment with front padding removed. The elastic ropes 23 attached to the eye screws 13 fastened to the PVC crosses 19 for the door-mounted frame 26 are strung from opposing corners inside the frame 26 and cross over one another near the center of the punching surface 35. The elastic ropes are secured by cable ties 33 to the punching surface 35. An optional punching surface edge padding 31 borders the punching surface 35 to provide extra padding and protection near the edges.

In all embodiments using a punching surface frame 26, the frame is constructed of rigid materials (such as wood or a plastic) that can support the punching surface 35 by the elastic ropes 23 that connect the punching surface 35 and the frame 26. The elastic ropes 23 may be elastomeric ropes or straps with varying degrees of elasticity as the user desires, but are not limited to elastomeric materials.

FIG. 3 also shows a dotted-line doorway to show how the invention is mounted. The doorway is not part of the claimed invention.

FIG. 3 also shows the optional location of an adjustment mechanism 49 which fixes the punching surface 35 in place so it does not move in relation to the straps. As discussed previously, two mounting straps are used in the current embodiment to fix the punching surface 35; they are mounted in the frame at one corner, and then go through a cable tie 33 that is affixed at one corner of the punching surface, cross diagonally across the surface, and then out the opposite corner.

The strap and surface connection can be constructed in a number of ways, including a single hole at each corner of the surface, with the strap entering the top hole or a cable tie 33, proceeding diagonally down the back of the surface, and then through another hole at the opposite corner where that respective strap is affixed at the top of the surface. To hold the surface at one height, the entire surface must be held in place in relation to the straps, or it can slowly slide down.

One means of fixing the height of the punching surface 35 is to construct the punching surface 35 so it has two holes located near each other near its center, a cable tie 33 is fed through from the back to the front and then back out the second hole, and that cable tie then can be fastened to both straps so they cannot move.

A second means of handling the height adjustment is to tighten the cable ties at each corner. The disadvantage to this approach is that four cable ties must be loosened in order to adjust the height of the surface.

Yet a third means of holding the punching surface in place is to use an adjustment mechanism 49 designed to allow a user to adjust the height with minimum complexity. One means would employ a construction wherein each of the two elastic ropes 23 go through two slotted holes in the central area of the punching surface 35. In this approach, the adjustment mechanism is the friction created as the ropes 23 pass from the back of the surface through a hole to the front, and then back through a second hole to get back to rear of the punching surface 35. The friction of the straps created by tension on the straps as they pass through the holes will prevent the punching surface 35 from sliding down while the elastic ropes 23 are taut. A user can change the height of the first surface by removing the tension, and then sliding the first surface along the straps to a desired location, and then remounting the surface and affixing the straps, either to a mounting frame as shown on FIG. 1 through FIG. 5, or pre-existing anchor positions as shown on FIG. 6 through 10.

The inventor asserts that there are many such methods of fixing the two elastic ropes together as they cross in the central portion of the punching surface 35, including but not limited to the use of a standard belt buckle connection using elastic ropes 23 which are straps and can employ a frame and prong connection to holes in the straps, or a screw lug connection that is tightened on the elastic ropes, similar to an electrical wiring lug. The straps can be simply tied together with a cable tie. The means by which the invention can be constructed to include an adjustment mechanism 49 are not limited to these examples.

Though the adjustment mechanism 49 is indicated and discussed in FIG. 3 as though it is on the front side of the punching surface 35, the invention can include the adjustment mechanism on either side of the punching surface 35.

Figure 4:
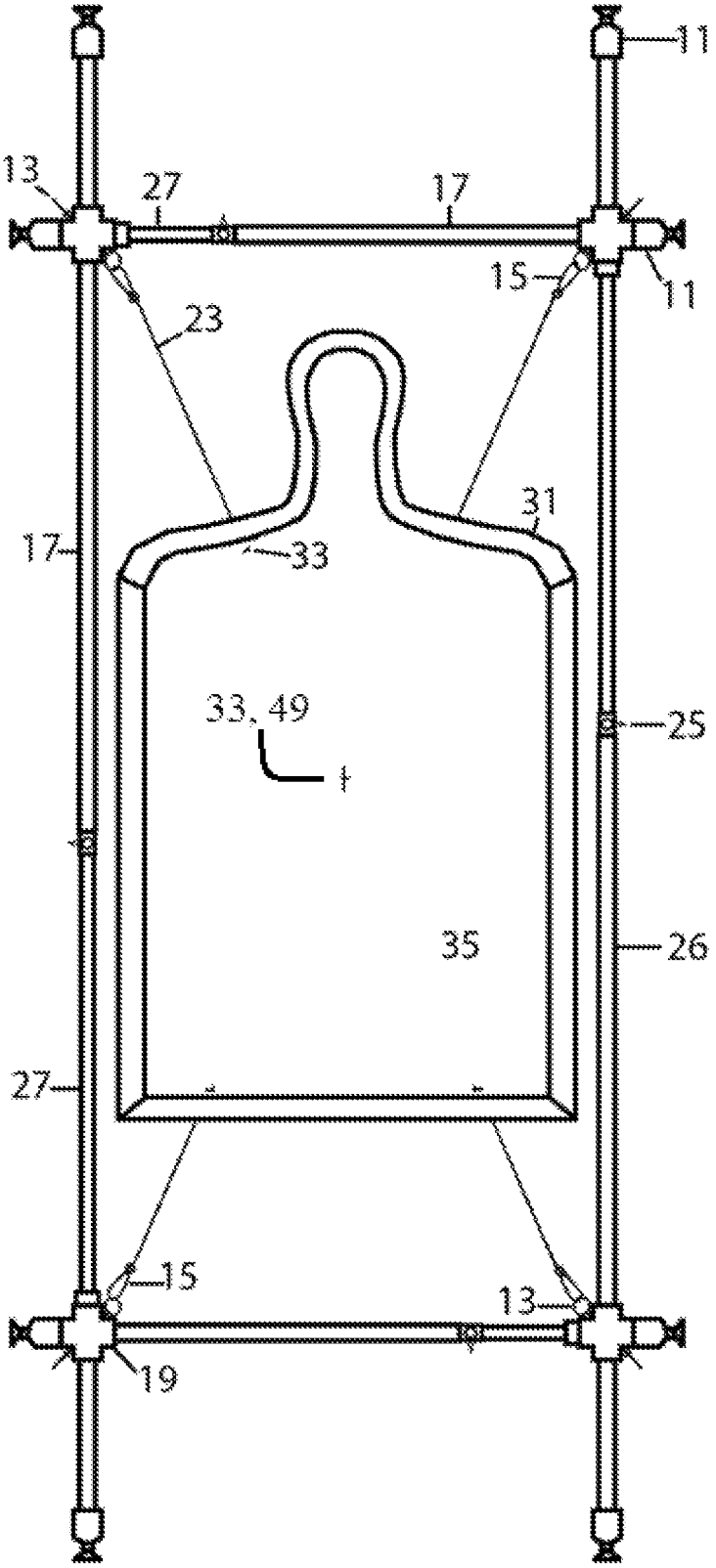
FIG. 4 is a rear view of an embodiment of the invention, a door-mounted punching surface embodiment with the rear padding removed.

FIG. 4 is a rear view of the door-mounted punching surface embodiment with the Punching Surface Back Padding 29 removed. The elastic ropes 23 are secured to the back of the punching surface 35 by cable ties 33. A cable-tie 33 serves as the adjustment mechanism 49 to fix the position of the elastic ropes 23 in the central portion of the punching surface. The punching surface edge padding 31 lines the edges of the punching surface 35 for protection and further padding.

Figure 5:
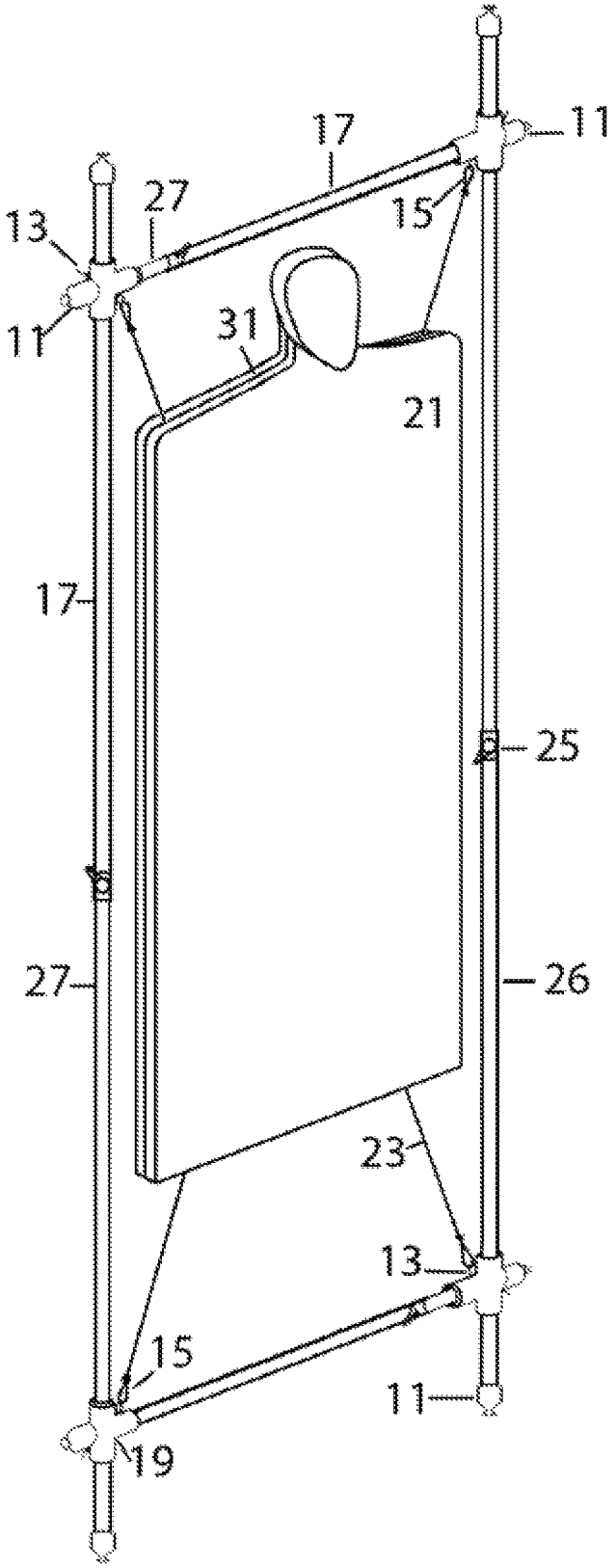
FIG. 5 is an orthogonal view of one embodiment of the invention, in this case as a door-mounted punching surface.

FIG. 5 is an orthogonal view of the door-mounted punching surface embodiment. The punching surface 35 is covered by the front padding 21 and lined with surface edge padding 31 with the elastic ropes 23 behind the punching surface 35 and punching surface back padding 29. When a user strikes the punching surface 35, it will be pushed backward by the force and be absorbed by the elastic ropes 23 secured to the door-mounted frame 26 and will quickly return the punching surface 35 to its original position.

Figure 6:
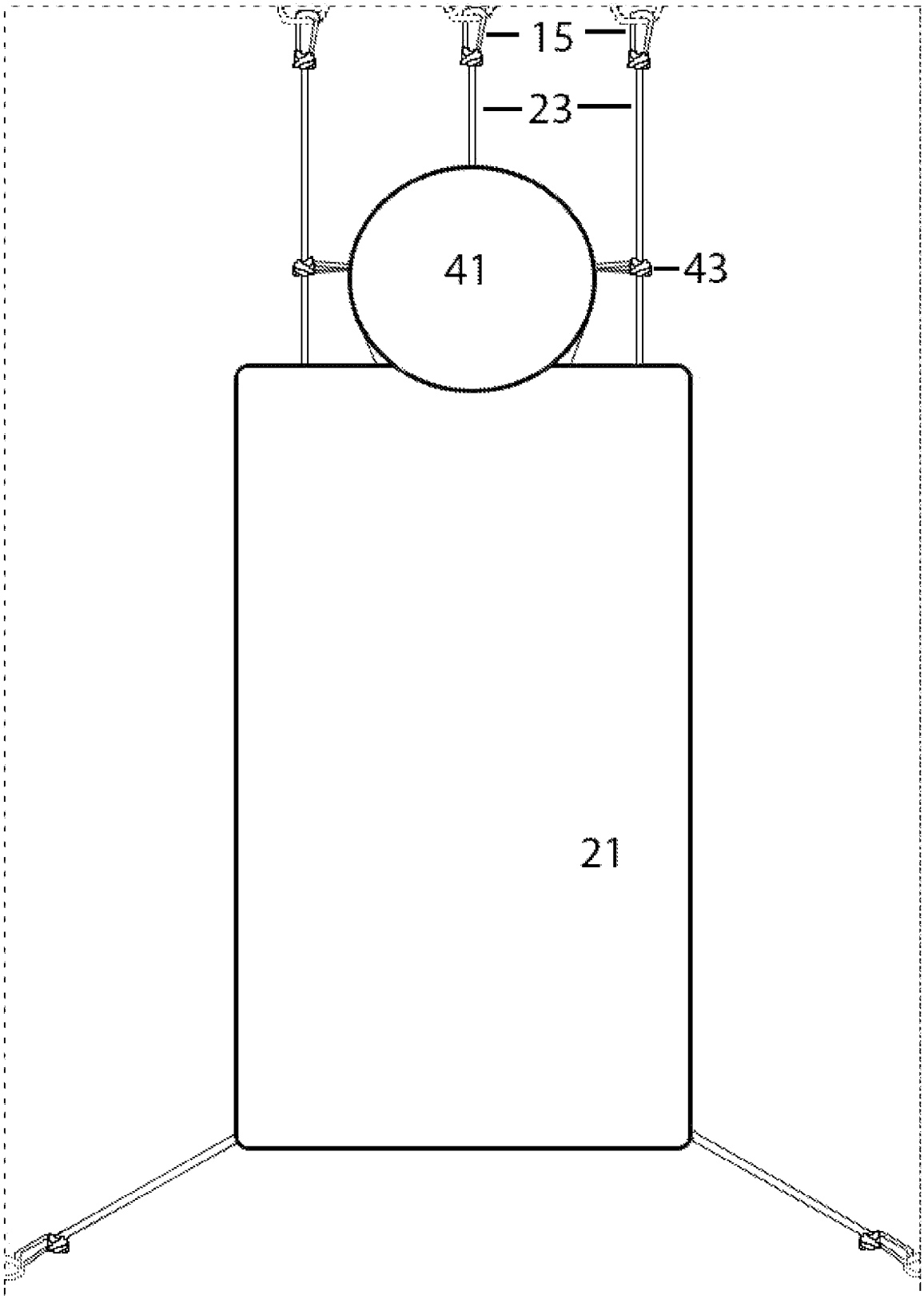
FIG. 6 is a front view of the invention configured as a rack-mounted punching surface embodiment with a head element.

FIG. 6 is a front view of the fitness rack mounted punching surface embodiment with a head element 41. In this embodiment, the punching surface 35 is hung and strung from a fitness rack or power rack. This allows for the punching surface 35 to be able to be hit and recover quickly to its original position, but is hung from fitness equipment rather than frame fitted in a doorway. The punching surface 35 has the elastic ropes 23 run between the punching surface 35 and front padding 21 or the back padding 29 in order to evenly distribute the forces of impact by the user. The elastic ropes 23 run from the bottom corners upward to the middle of the punching surface 35 with carabiners 15 at the end of the ropes so the user can hang the punching surface 35 to the rack from the top and secure it by attaching the ropes from the bottom corners to the rack. In this embodiment the punching surface head 41 at the top of the punching surface 35 is secured with adjustable ropes 23 and 43 but can be moved independently from the punching surface 35.

Figure 7:
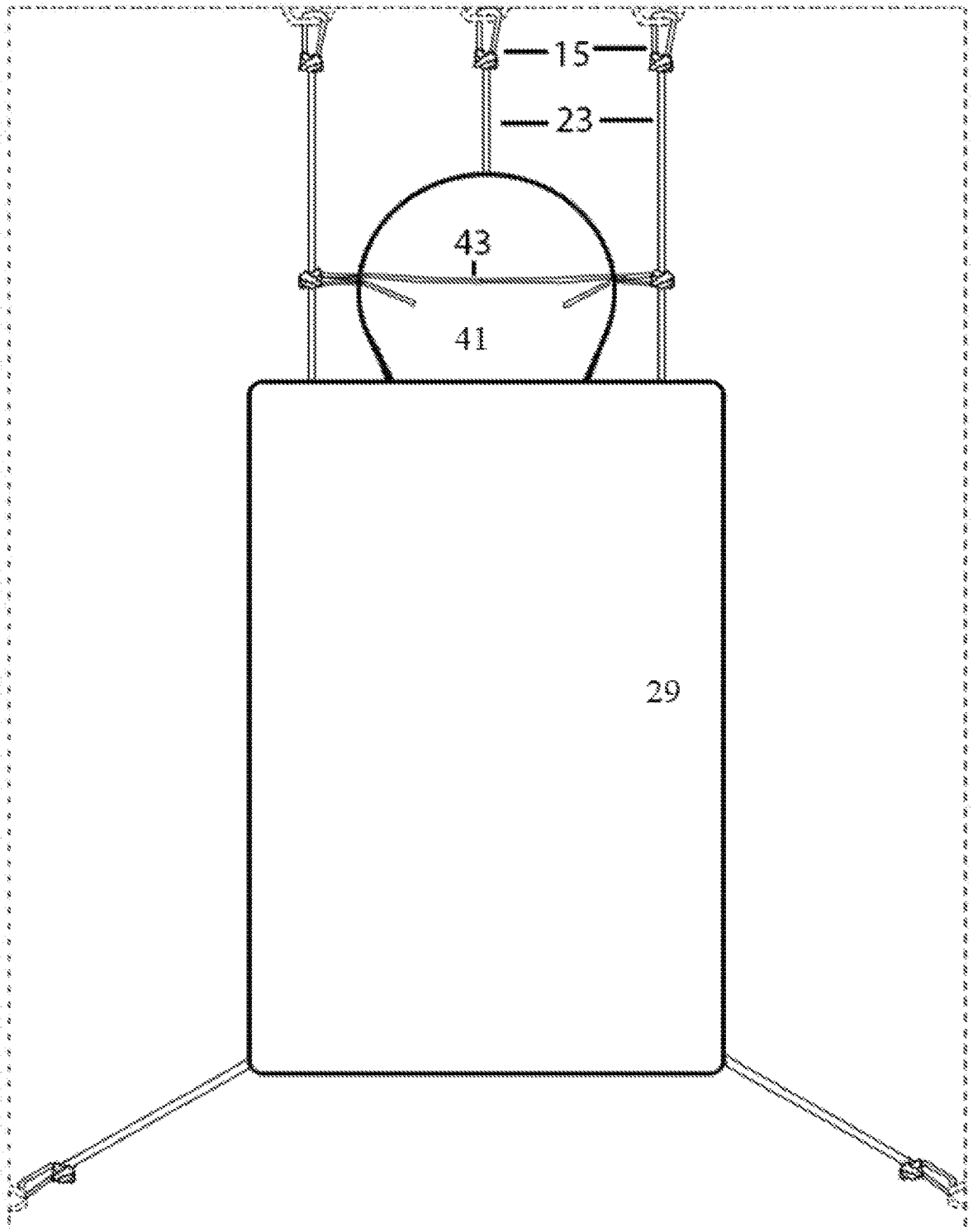
FIG. 7 is a rear view of the invention configured as a rack-mounted punching surface embodiment with a head element.

FIG. 7 is a rear view of the fitness rack mounted punching surface embodiment with a head element. This embodiment is hung from a fitness or power rack so that the punching surface 35 can absorb forces of impact by users. The punching surface head 41 of the punching surface 35 is supported from behind by adjustable ropes 43 but can move independently from the punching surface 35. The punching surface 35 is supported by elastic ropes 23 with carabiners 15 attached to the power rack that run through the body of the punching surface 35 from the top to the bottom corners.

Figure 8:
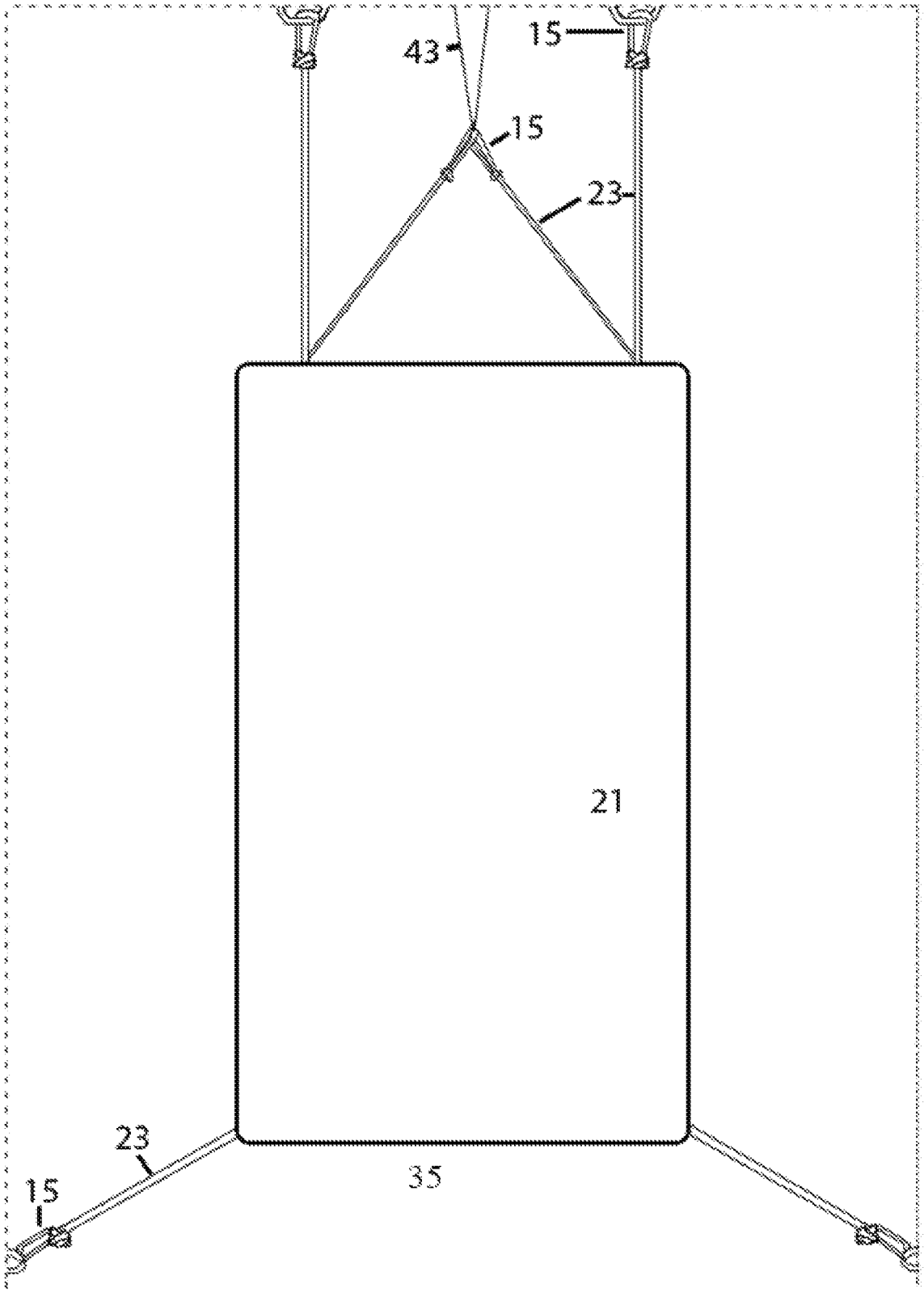
FIG. 8 is a front view of the rack-mounted punching surface embodiment of the invention without a head element.

FIG. 8 is a front view of the fitness rack mounted punching surface embodiment without a head element. This embodiment is hung from a fitness or power rack so that the punching surface 35 can absorb forces of impact by users, assisted by the front padding 21. The punching surface 35 is supported with elastic ropes 23 that run from the top to the bottom corners. Without a head element, this embodiment uses elastic ropes connected to adjustable ropes 43 to add more or less support to the punching surface 35.

Figure 9:
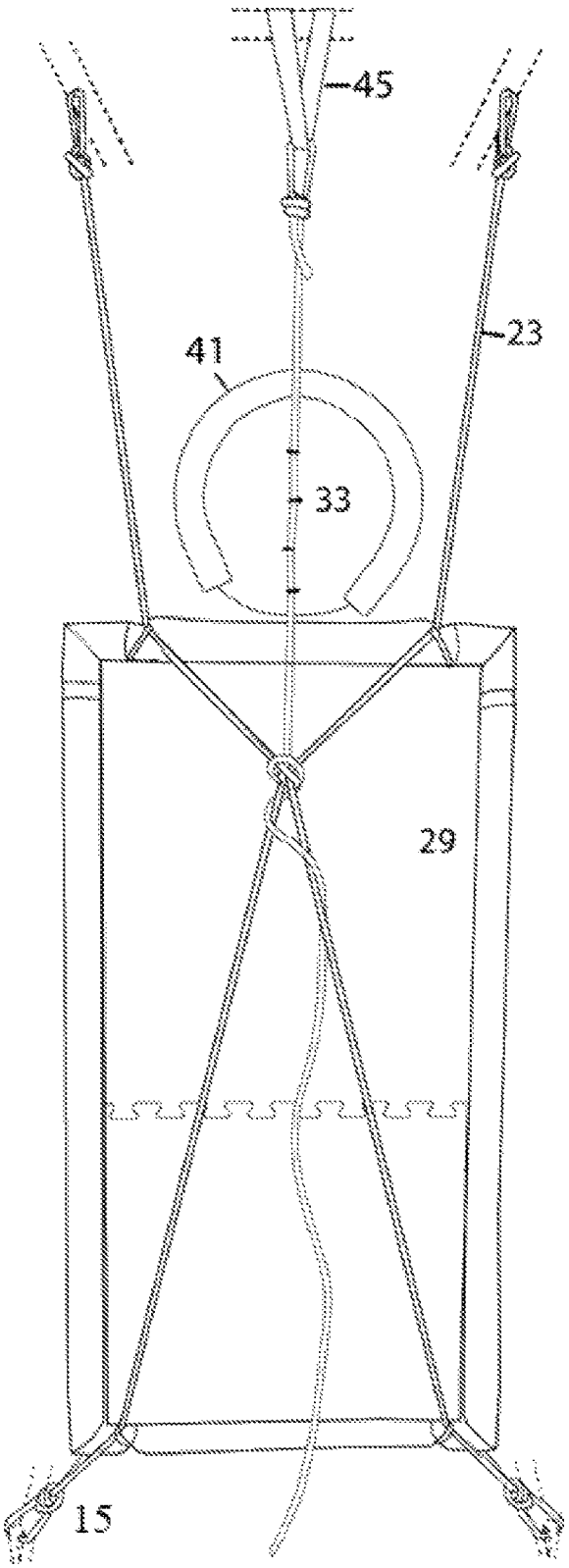
FIG. 9 is a front view of the wall-mounted punching surface embodiment of the invention without front padding.

FIG. 9 is a front view of an embodiment of the invention mounted on a wall or rack, with front padding removed. This embodiment shows the punching surface 35 and optional independently moving head surface 41 attached by cable ties 33 to elastic ropes 23 and carabiners 15, with an adjustable strap 45 construction using fixed existing mounting points (not part of the claimed invention).

Figure 10:
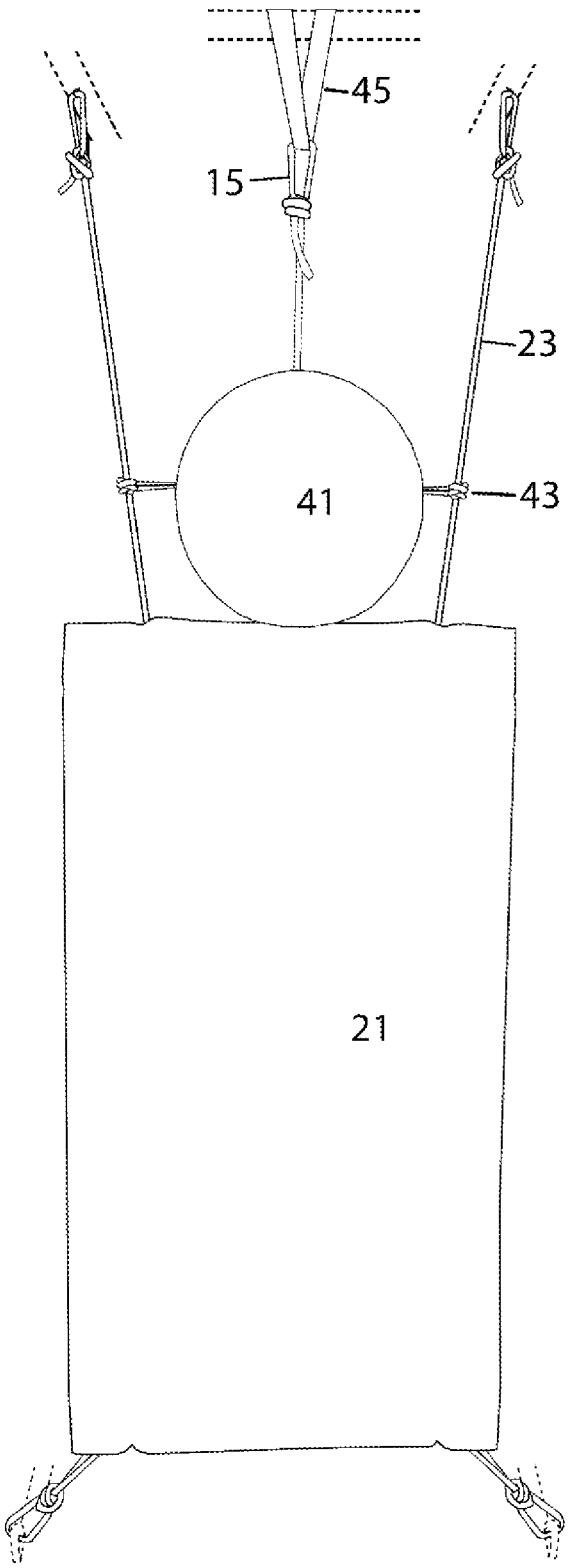
FIG. 10 is a front view of the invention as a wall-mounted punching surface embodiment.

FIG. 10 is a front view of the wall-mounted punching surface embodiment. The elastic ropes 23 attached by carabiners 15 with an adjustable strap 45 to a wall mount are run through and secured to the punching surface 35 by cable ties 33. The punching surface head 41 is supported by adjustable ropes 43.

FIG. 11 is an orthogonal view of the lock pin 25. The lock pin 25 connects the Metal pipe framing elements 17 to the PVC pipe frame elements 27 to construct the mounting frame 26. The PVC pipe frame elements 27 may have multiple holes for the lock pin 25 to allow a user to adjust the size of the mounting frame 26. The invention is not limited to this construction.

The inventor notes that the punching surface head may employ a removable padding similar to the front padding 29 used on the punching surface 35, but may also be of a softer material which needs no padding. FIG. 9 shows an embodiment using removable padding; FIG. 10 assumes a one-piece punching surface head 41.

The inventor also notes that the punching surface edge padding 31 in the embodiment shown in the FIGS. 1-5 covers the front and back, curling over the edge of the punching surface 35, but this protective cushion may be constructed to just cover just one side of the edge of the punching surface 35.

Lastly, the inventor notes that the frame 26 as shown in the figures does not include a consistent configuration. This is by design to show the multiplicity of ways in which the frame may be constructed with the PVC piping joined with metal piping. While the corners of each frame 26 are shown in these drawings as constructed as a PVC corner, a metal corner works as well.

A legend of components discussed herein follows:

Suction Cup Attachment 11
Eye Screw 13
Carabiner 15
Metal Pipe Framing Elements 17
PVC Cross 19
Front Padding 21
Elastic Ropes 23
Lock Pin 25
Frame 26
PVC Pipe Framing Elements 27
Punching Surface Back Padding 29
Punching Surface Edge Padding 31
Cable Tie 33
Punching Surface 35
Punching Surface Head 41
Adjustable ropes 43
Adjustable strap 45
Eye Screw Nut 47
Adjustment Mechanism 49

The inventor claims:

1. A punching surface, comprising:

a. a first surface;

b. at least one of front padding, edge padding, and back padding covering the first surface;

c. a mounting frame constructed to mount in a doorway;

d. two or more elastic mounting straps, each of which has two ends, a first end affixed to the first surface and a second end attached to the mounting frame, such that the first surface is suspended taut within the mounting frame;

e. wherein the mounting frame is constructed of four corners and four sides, the four corners constructed of polyvinyl chloride (PVC), and the four sides of the mounting frame constructed of PVC piping and metal piping, such that the metal piping is sized to slide snugly inside the PVC piping and multiple holes in the metal piping marry to a set of matching holes in the PVC piping with a lock pin connection so the mounting frame's size can be adjusted, the mounting frame's PVC corners further comprising suction cups to assist the mounting frame to remain fixed into a door frame.

2. The punching surface of claim 1, wherein the edge padding is configured to protect edges of the first surface.

3. The punching surface of claim 1, further including a head-shaped portion on a top of the first surface.

4. The punching surface of claim 1, further including an independently moving head surface mounted near a top of the first surface such that the first surface and the independently moving head surface can move individually when struck by a user.

5. The punching surface of claim 4, in which the independently moving head surface is mounted with additional mounting straps to the first surface and the mounting frame.

6. The punching surface of claim 1, in which the mounting frame can adjust in size to fit different doorway sizes.

7. The punching surface of claim 1, in which the straps comprise a user-adjustable length.

8. The punching surface of claim 1 in which the mounting frame is constructed of polyvinyl chloride tubing in a rectangular shape and comprises suction cups at the frame's corners to assist the frame in mounting into a door frame.

* * * * *